US009168411B2

(12) United States Patent
Holman

(10) Patent No.: US 9,168,411 B2
(45) Date of Patent: Oct. 27, 2015

(54) EXERCISE ROLLER WITH RESISTANCE BANDS

(76) Inventor: Jeffrey T Holman, Farmington, UT (US)

( * ) Notice: Subject to any disclaimer, the term of this patent is extended or adjusted under 35 U.S.C. 154(b) by 461 days.

(21) Appl. No.: 13/526,313

(22) Filed: Jun. 18, 2012

(65) Prior Publication Data

US 2012/0322633 A1 Dec. 20, 2012

Related U.S. Application Data

(60) Provisional application No. 61/498,506, filed on Jun. 17, 2011, provisional application No. 61/534,440, filed on Sep. 14, 2011.

(51) Int. Cl.

| | |
|---|---|
| ***A63B 22/20*** | (2006.01) |
| ***A63B 21/02*** | (2006.01) |
| ***A63B 21/055*** | (2006.01) |
| ***A63B 21/00*** | (2006.01) |
| ***A63B 23/035*** | (2006.01) |

(52) U.S. Cl.

CPC ..... *A63B 21/028* (2013.01); *A63B 21/0555* (2013.01); *A63B 21/0557* (2013.01); *A63B 21/1465* (2013.01); *A63B 21/1469* (2013.01); *A63B 21/151* (2013.01); *A63B 23/03541* (2013.01); *A63B 22/20* (2013.01); *A63B 2021/022* (2013.01); *A63B 2210/50* (2013.01); *A63B 2225/62* (2013.01)

(58) Field of Classification Search

CPC ..... A63B 22/20; A63B 21/0004; A63B 23/0211; A63B 21/1469; A63B 21/015; A63B 2210/50; A63B 21/1496; A63B 21/0552; A63B 21/0557; A63B 21/055; A63B 21/00065; A63B 21/00061; A63B 2071/025; A63B 21/028; A61H 2015/0014; A61H 15/00

USPC ..... 482/123, 51, 98, 102, 131–132, 148; 601/99, 119–121, 136

See application file for complete search history.

(56) References Cited

U.S. PATENT DOCUMENTS

| | | | | | |
|---|---|---|---|---|---|
| 1,254,974 | A | * | 1/1918 | Briggs | 482/132 |
| 3,298,687 | A | | 1/1967 | Douglas | |
| 3,419,268 | A | * | 12/1968 | Bellet | 482/132 |
| 4,293,125 | A | * | 10/1981 | Hinds | 482/82 |
| 4,552,356 | A | * | 11/1985 | Brousseau | 482/125 |

(Continued)

FOREIGN PATENT DOCUMENTS

| | | |
|---|---|---|
| WO | 01/02058 | 1/2001 |

OTHER PUBLICATIONS

Copenheaver, Blaine R. "PCT International Search Report for PCT/US2012/042994", (Aug. 31, 2012), 2 pages.

(Continued)

*Primary Examiner* — Loan H Thanh
*Assistant Examiner* — Andrew S Lo
(74) *Attorney, Agent, or Firm* — Jeffrey T. Holman

(57) ABSTRACT

An exercise apparatus includes a body roller and at least one resistance band. The body roller includes an interior channel. The resistance band passes through the interior channel of the body roller. Ends of the resistance band extend outward on each side of the body roller. The body roller facilitates applied pressure to a user's body. The resistance bands facilitate resistance training exercises by the user. The body roller provides a structural support for the resistance bands during the resistance training exercises.

4 Claims, 7 Drawing Sheets

(56) References Cited

U.S. PATENT DOCUMENTS

| | | | | |
|---|---|---|---|---|
| 5,643,149 | A * | 7/1997 | Grimaldi et al. | 482/82 |
| 5,681,248 | A * | 10/1997 | Vani | 482/126 |
| 6,203,476 | B1 * | 3/2001 | Wang et al. | 482/121 |
| 6,705,974 | B1 * | 3/2004 | Tardif | 482/39 |
| 7,108,646 | B1 * | 9/2006 | Quick | 482/148 |
| 7,153,247 | B1 * | 12/2006 | Filkoff | 482/121 |
| 7,175,573 | B1 * | 2/2007 | Huang | 482/110 |
| 7,387,599 | B1 * | 6/2008 | Hsu | 482/132 |
| 7,645,217 | B2 * | 1/2010 | Habing et al. | 482/140 |
| 8,021,273 | B2 * | 9/2011 | Kopp | 482/35 |
| 8,033,966 | B2 * | 10/2011 | Ayoub | 482/121 |
| 8,043,196 | B1 * | 10/2011 | Chen | 482/82 |
| 8,672,818 | B2 * | 3/2014 | Welch | 482/132 |
| 2002/0187885 | A1 | 12/2002 | Liao | |
| 2003/0224914 | A1 * | 12/2003 | De Montesquieux | 482/148 |
| 2004/0082447 | A1 | 4/2004 | Chaplin | |
| 2006/0163894 | A1 * | 7/2006 | Mishek et al. | 294/171 |
| 2006/0223683 | A1 | 10/2006 | Orona | |
| 2007/0173387 | A1 * | 7/2007 | Wu | 482/121 |
| 2007/0207905 | A1 * | 9/2007 | Winston | 482/126 |
| 2008/0108484 | A1 | 5/2008 | Wu et al. | |
| 2008/0167168 | A1 * | 7/2008 | Hurst | 482/132 |
| 2008/0200851 | A1 * | 8/2008 | Faussett | 601/119 |
| 2010/0113992 | A1 | 5/2010 | Godfrey et al. | |
| 2011/0183825 | A1 * | 7/2011 | Yang et al. | 482/132 |
| 2011/0263391 | A1 * | 10/2011 | Welch | 482/93 |
| 2011/0312477 | A1 * | 12/2011 | Wiseman | 482/126 |
| 2012/0028769 | A1 * | 2/2012 | Ayoub et al. | 482/121 |
| 2012/0065557 | A1 * | 3/2012 | Phillips | 601/99 |
| 2014/0228180 | A1 * | 8/2014 | Walker | 482/82 |

OTHER PUBLICATIONS

Copenheaver, Blaine R. "PCT Written Opinion of International Searching Authority for PCT/US2012/042994", (Aug. 31, 2012), 4 pages.

"Tiger Tail To-Go" available at: http://www.tigertailusa.com/, last accessed Aug. 16, 2012, 1 page.

"Rubberbanditz Mobile Gym Kits" available at: http://www.rubberbanditz.com, last accessed Aug. 15, 2012, 2 pages.

"Nordic Track Foam Rollers" available at: www.nordictrack.com, last accessed Aug. 15, 2012, 1 page.

"Absoflat Core Fitness Trainer" available at: http://www.absoflat.com/, last accessed Aug. 15, 2012, 1 page.

* cited by examiner

EXERCISE ROLLER WITH RESISTANCE BANDS

CROSS-REFERENCE TO RELATED APPLICATIONS

This application claims the benefit of U.S. Provisional Application No. 61/498,506, filed on Jun. 17, 2011. This application further claims the benefit of U.S. Provisional Application No. 61/534,440, filed on Sep. 14, 2011. Each of these references is incorporated by reference in their entirety.

BACKGROUND

The convenience and ease of personal and home exercise equipment is an attraction for many interested in personal fitness. Conventional systems are designed to conserve space and maintain portability. However, an increase in portability in conventional systems has often resulted in a reduction in functionality. Conventional systems have become highly specialized which requires a fitness enthusiast to own and/or use multiple individual systems in order to perform a few exercises. For example, if a fitness enthusiast is doing an exercise with one piece of equipment and then moves to another exercise, with many conventional systems an entirely separate piece of equipment must be used. Using multiple pieces of equipment can be limiting and time consuming.

SUMMARY

Embodiments of an apparatus are described. In one embodiment, the apparatus is for exercising. The apparatus includes a body roller comprising an interior channel and at least one resistance band passing through the interior channel of the body roller. Ends of the resistance band extend outward on each side of the body roller. Other embodiments of the apparatus are also described.

Embodiments of a method of making a body roller for exercising are described. In one embodiment, the method includes installing at least one resistance band at least partially within an interior channel of a body roller. At least one resistance band extends from at least one end of the body roller. The method also includes connecting a user interface accessory to an end of the at least one resistance band. The user interface accessory is configured to facilitate user manipulation of at least one resistance band while a portion of the at least one resistance band is disposed within the interior channel of the body roller. Other embodiments of a method are also described.

Embodiments of a system for exercising are described. In one embodiment, the system includes application means for applying rolling pressure to a body, resistance means coupled to the application means, and interface means coupled to the resistance means. The resistance means is extendible from end portions of the application means. The interface means facilitate handling of the resistance means by a user. Other embodiments of a system are also described.

BRIEF DESCRIPTION OF THE DRAWINGS

Throughout the description, similar reference numbers may be used to identify similar elements.

DETAILED DESCRIPTION

Figure 1:
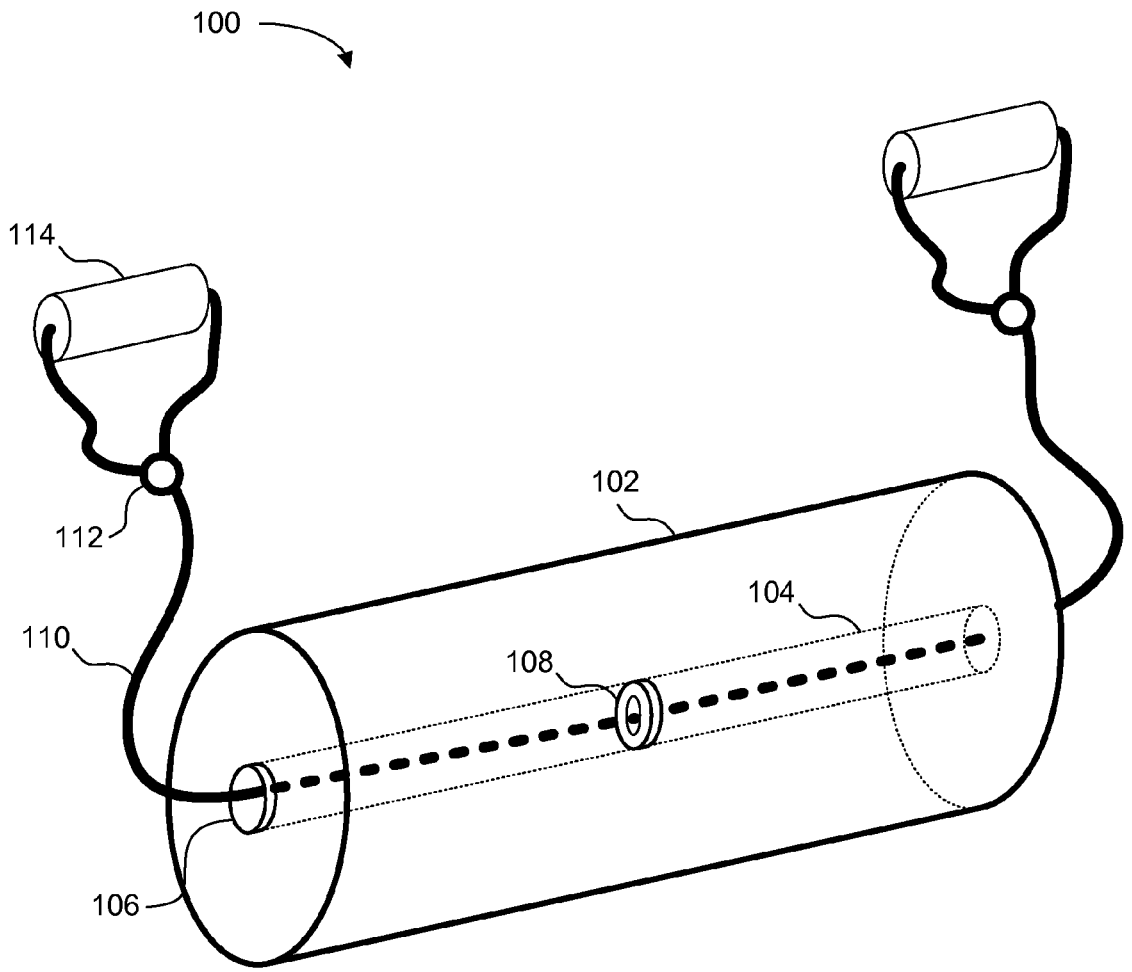
FIG. 1 illustrates a schematic view of one embodiment of an exercise apparatus.

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some embodiments of the invention include an apparatus for exercise. Embodiments of the apparatus facilitate multifunctional exercise routines which may include resistance training, balance, stretching, massage, and other potentially beneficial exercises.

FIG. 1 illustrates a simple schematic of one embodiment of an exercise apparatus 100. In the illustrated embodiment, the apparatus 100 includes a body roller 102, an interior channel 104, a guide 106, an anchor point 108, and a resistance band 110. In some embodiments, the body roller 102 is foam. In other embodiments, the body roller 102 may be plastic, fabric, rubber, elastic, an inflatable gas or liquid cell, or other material. In some embodiments, the body roller 102 has material properties to facilitate thermal storage for application of heat or cold. For example, the body roller 102 may be used to apply heat to sore or cramped muscles. Additionally, the body roller 102 may be chilled to apply a cold compress to the body.

In the illustrated embodiment, the interior channel 104 is centered axially within the body roller 102. In other embodiments, the interior channel 104 may be off-center within the body roller 102 to increase stability when holding the body roller 102 to the body using the resistance band 110. For example, if a user were standing with the body roller placed behind the shoulders and extending the resistance bands 110 in a forward horizontal pushing motion, an off-center orientation for the internal channel 104 may help the user keep the roller in a relatively stationary position during the exercise.

In some embodiments, the guide 106 is mounted within the interior channel 104. The guide 106 may function as a structural element to maintain the shape and alignment of the body roller 102. In other embodiments, the guide 106 reduces wear on the resistance band 110 and/or the body roller 102. For example, the ends of the guide 106 may extend beyond the corresponding ends of the body roller 102 so that the resistance bands 110 do not rub much or at all along the outer surfaces of the body roller 102. This may preserve the integrity of the body roller 102, especially if the ends of the body roller 102 are foam, rubber, or another soft material that may be damaged by pressure or abrasion of the resistance bands 110.

In some embodiments, the ends of the guide 106 are flared (refer to FIGS. 3 and 4) to form a relatively smooth transition for the bands 110. The flare may be gradual or abrupt. In one embodiment, the flare provides an opening which is larger than dimensions of an interior cross-section of the guide 106. For example, if the guide 106 has an inner diameter of about two inches, then the opening may have an inner diameter of about 2.5 to 5 inches. In other embodiments, the opening of the flare is about 125-300% of the size of the inner diameter of the guide 106. The flare may be implemented based on any type of linear, multi-linear, or curvilinear transition from the inner diameter of the guide 106 to the final opening dimensions of the guide 106. The flare also may be implemented to form a relatively flat lip or flange at the end to sit flush or flat against the end surface of the roller 102. This may help to protect the end of the roller 102 from being contacted and potentially damaged by the bands 110.

In one embodiment, the guide 106 is formed from a single piece of plastic or metal piping. The guide 106 may be inserted into the channel 104 of the roller 102 prior to forming the flared ends. And then, once the guide 106 is inserted, mechanical or thermomechanical processes may be used to deform the original dimensions of the guide 106 to form the flared ends. For example, in the case of a metal guide 106, the metal guide 106 may be rolled or pressed to gradually flare out at each end. As another example, in the case of a plastic guide 106, the guide 106 may be heated and then pressed against a mold having the shape of the flare. When heating the guide 106, it may be beneficial to use a thermal barrier between the outer surface of the guide 106 and the interior surface of the channel 104 within the foam roller 102 so as not to melt the foam roller 102. In one embodiment, the mold may be heated so that the end of the guide 106 is heated from the inside, while limiting the heat transfer to the foam roller 102, and then forced into the flared configuration. By forming the flared ends of the guide 106 while the guide 106 is already inserted into the foam roller 102, the guide 106 may be securely attached within the foam roller 102 with very little possibility of coming out.

In another embodiment, the guide 106 may be formed in two or more pieces. For example, the guide 106 may be formed in at least two pieces which each have a flare end and then subsequently are inserted into the channel 104 of the roller 102. A coupling (not shown) may be used to join each of the guide pieces within the roller 102. As one example, the guide 106 may be formed with two pieces, each having a flared end, and a single coupling between the two pieces. As another example, the guide 106 may be formed with three or more pieces, including two flared end pieces and at least one straight middle piece to join the flared end pieces together.

The flared end pieces, as well as any other piece, of the guide 106 may be formed of a plastic that is characterized by a relatively low coefficient of friction. One example of such a plastic is available under the trade name of Delrin available from DuPont. Other types of low-wear and/or low-friction materials may be used. Alternatively, or in addition to using low-friction materials, the inner surface of the flare may be coated with a low-friction coating.

In some embodiments, the resistance bands 110 are removable from the apparatus 100. In other embodiments, the resistance bands 110 are integrated such that the resistance bands 110 are not configured for easy removal from the guide 106 and/or the body roller 102.

In some embodiments, the guide 106 includes an anchor point 108. The anchor point 108 serves as an anchor to maintain the resistance band 110 centered with respect to the body roller 102 and guide 106. In some embodiments, the guide 106 may include two or more anchor points 108 located throughout the guide 106. For example, the guide 106 may have an anchor point 108 at each end of the guide 106 to prevent pinching of skin or clothing during extension or relaxation of the resistance band 110. Other embodiments may include other orientations of the guide 106 and anchor points 108.

In some embodiments, the guide 106 includes oversized ends to allow internal storage of the resistance band 110 and handle 114. This may facilitate storage and/or transport of the apparatus 100. In addition, the ability to store the resistance bands 110 and handles 114 within the guide 106 may facilitate exercises that do not use or may be hindered by the resistance bands 110 extending out of the primary structure of the body roller 102. Alternatively, the bands 110 and/or handles 114 may be at least partially fitted into corresponding depressions within the outer structure of the body roller 102. For example, a body roller 102 made of foam may have depressions which accommodate storage of the handles 114 using friction, compression, magnetism, or another mechanism to maintain the handles 114 within the foam. While stored, the handles 114 may be substantially flush with, or recessed within, the outer surface of the foam (or other exterior material) of the body roller 102.

In some embodiments, the guide 106 includes a cap to close the end of the guide 106. This would allow a user to store the resistance band 110 and handle 114 inside the guide 106 and close the guide 106. This would increase the portability of the apparatus 100 without sacrificing the resistance band functionality.

In some embodiments, the guide 106 may include an adapter portion to connect multiple body rollers 102 to form a longer roller. For example, the ends of the guide 106 may have internal and/or external threads, and the other end of the guide may have external threads so that the internal threaded end (or external threaded end) may be mated with and attached to the external threaded end (or internal threaded end) of another similar apparatus 100.

In some embodiments, the guide 106 may facilitate use of a pulley or other accessory at the end of the guide 106 to allow a user to perform certain exercises. In other embodiments, the resistance bands 110 may attach to the roller body 102 in another way. For example, the resistance bands may attach to pulleys or another receiving structure located at one or both ends of the roller body 102. In other embodiments, resistance coils, springs, or other elastic or deformable structures (of any kind) may be inserted through or attached to the body roller 102. For example, spool structures (not shown) which provide resistance to non-elastic bands or cords may be mounted on each end of the body roller 102.

In the illustrated embodiment, the resistance band 110 includes an attachment point 112 which is configured to attach a handle 114 or other accessory to the resistance band 110. The attachment point 112 may be a hook, tie, threaded joiner, buckle, or other form of connection. Other accessories for attachment at the attachment point 112 may include loops, straps, hooks, and grips. For example, the attachment point 112 may facilitate use of a handle for arm exercises, a loop or strap for leg exercises, etc.

Figure 2A:
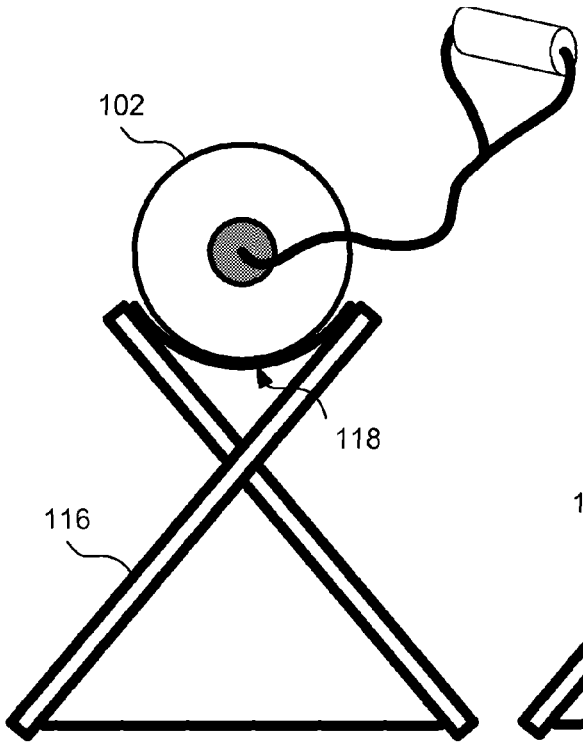
FIGS. 2*a-c* illustrates several schematic diagrams of different embodiments of the body roller placed in a structural support.

FIG. 2*a* illustrates one embodiment of the body roller 102 placed in a structural support 116. In this embodiment, the structural support 116 includes a receiver surface 118. The receiver surface 118 accommodates and supports the body roller 102. The receiver surface 118 may be made of fabric, leather, mesh, or other flexible material. Other embodiments of the receiver surface 118 may be rigid. For example, the receiver surface 118 may be formed of wood, metal, plastic, etc. The receiver surface 118 allows the body roller 102 to sit securely on the structural support 116. This may allow a user to sit on the body roller 102 to perform seated exercises. Alternatively, this may allow the user to place weight on the body roller 102 in an elevated position using other parts of the body (e.g., the lower legs while the user lies nearby on his back on the floor). The receiver surface 118 may include additional functionality to secure the body roller 102 to the structural support. For example, the receiver surface may have clips, straps, hooks, bands, magnets, or other elements to secure the body roller 102 during exercise, storage, or transport.

The structural support 116 may be a crossed member folding configuration as illustrated. Other embodiments of the structural support 116 may include a box frame, vertical leg, single post, or other configuration. In some embodiments it may be desirable to have a collapsible configuration for the structural support 116 for increased portability. One example of a collapsible configuration is a "scissor" mechanism common in collapsible lawn chairs or stools. In some embodiments, the guide 106 may have sufficient internal dimensions to accommodate internal storage of the support structure 116. Other embodiments may use other support structures such as chairs, stools, benches, stands, etc.

Figure 2B:
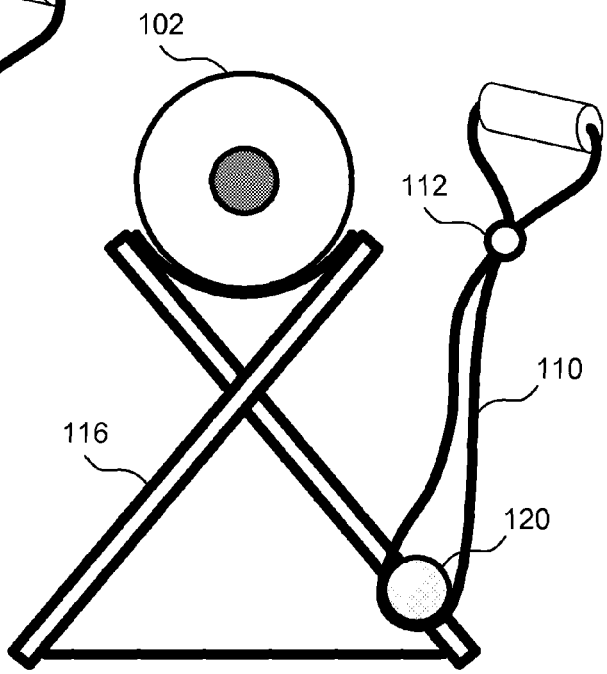

FIG. 2*b* illustrates another embodiment of the structural support 116 for use with the body roller 102. In the illustrated embodiment, the structural support includes a securing point 120. The securing point allows a user to secure the resistance band 110 to a portion of the structural support 116. In some embodiments the securing point 120 is a post. In other embodiments, the securing point 120 may be a notch, hook, pulley, hole, clasp, clamp, eyelet, or other element for securing. The securing point 120 allows a user to perform exercises with a different trajectory than exercises with the resistance band 110 placed within the body roller 102. In the illustrated embodiment, the resistance band 110 is doubled at the securing point 120 and connected at the attachment point 112. In other embodiments, the resistance band 110 may be attached at another point along the resistance band 110. In another embodiment, an end of the resistance band 110 is attached directly to the securing point 120. For example, the handle 114 may be hooked or otherwise attached to the attachment point 112 so that the body roller 102 can be extended away from the attachment point 112 under the resistance of the resistance bands 110. Other methods of connecting the resistance band 110 to the structural support 116 may facilitate other trajectories and exercise positions.

In other embodiments, the guide 106 may be removable from the body roller 102 for use alone or with the resistance bands 110. As one example, a user may remove the guide 106 with the bands 110 from the body roller 102 for performing bicep curls while the handles 110 (or end loops or other band arrangements) of the bands are secured at the user's feet.

Figure 2C:
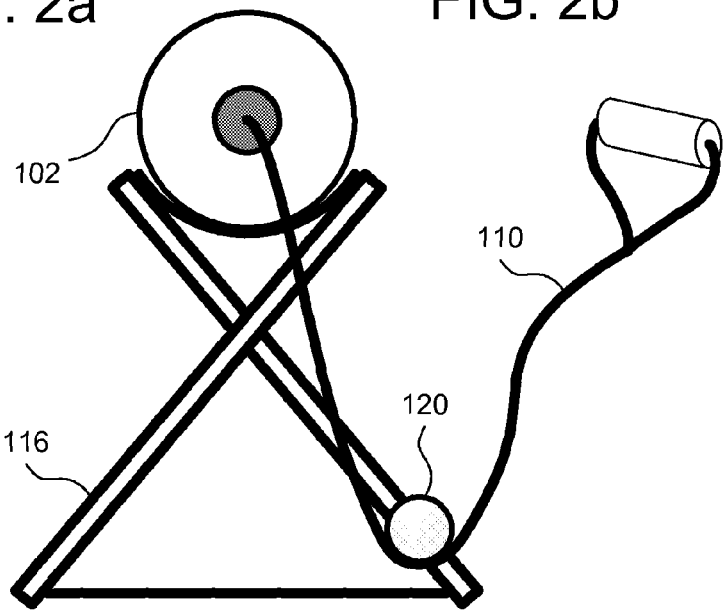

FIG. 2*c* illustrates another embodiment of the structural support 116 with the securing point 120. In the illustrated embodiment the resistance band 110 is connected to the body roller 102 through the interior channel 104 (see FIG. 1) of the body roller 102. The resistance band 110 wraps around the securing point 120. In the illustrated embodiment, a user may reposition the resistance band 110 without disconnecting the resistance band 110 from the body roller 102. In this embodiment, the securing point may be a pulley, low resistance surface, ball bearing, or other mechanism for redirecting the force from the resistance band 110 with low friction.

Figure 3:
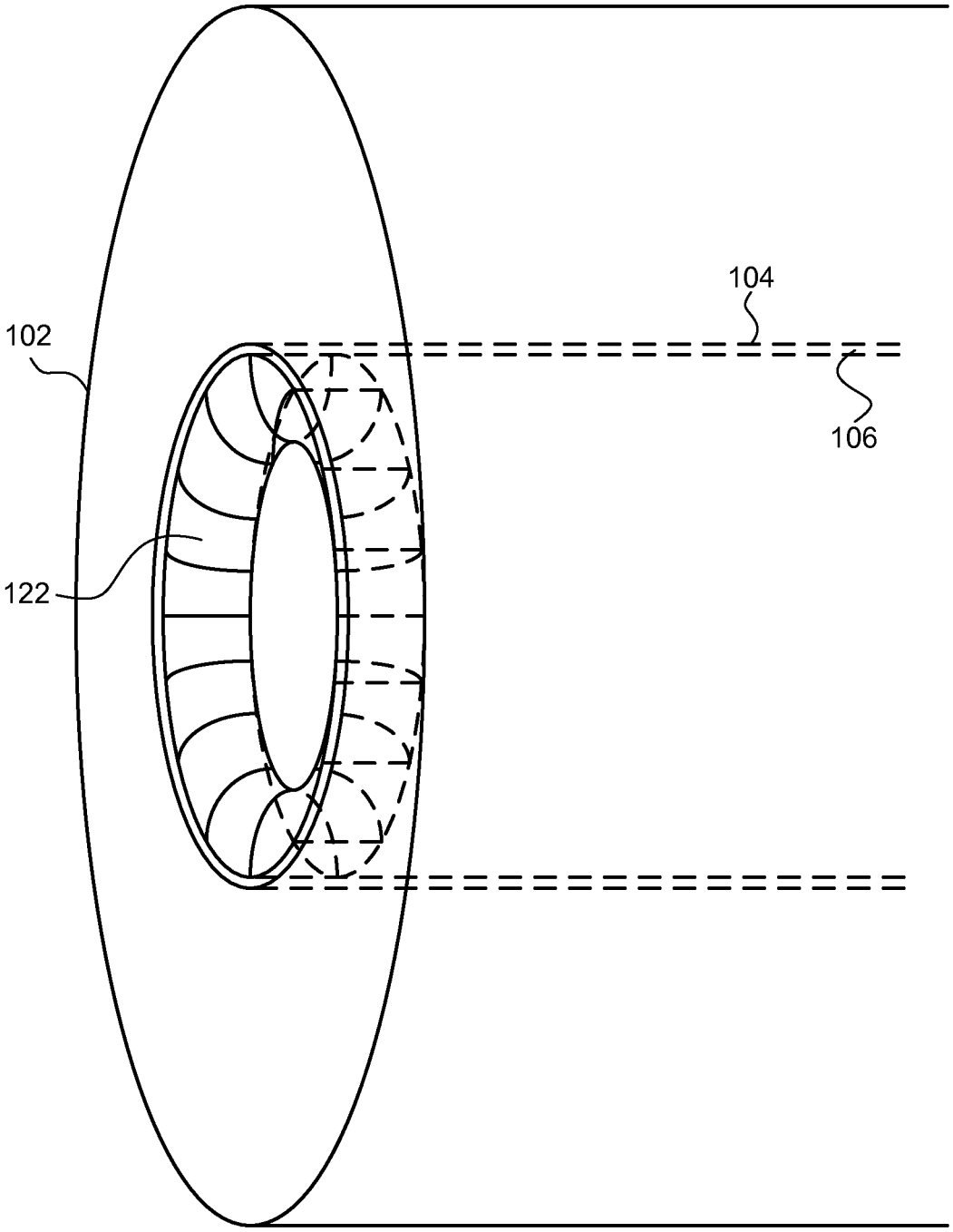
FIG. 3 illustrates a schematic view of one embodiment of a vortex end cap installed within a body roller.

FIG. 3 illustrates a schematic view of one embodiment of a vortex end cap 122 installed within a body roller 102. The vortex end cap 122 is shown coupled to the guide 106 within the interior channel 104 of the body roller 102. In the illustrated embodiment, the vortex end cap 122 is oriented to be flush with the end of the body roller 102 and the guide 106. In other embodiments, the vortex end cap 122 extends beyond the threshold of the body roller 102. In other embodiments, the vortex end cap 122 is recessed within the interior channel 104 of the body roller 102. In some embodiments, the vortex end cap 122 is partially toroidal in geometry. Much like the inner half of a donut, the vortex end cap 122 has a relatively flat outer surface with a revolved spherical interior surface. The relatively flat outer surface facilitates mounting the vortex end cap 122 within the body roller 102 while the toroidal interior geometry facilitates control of resistance bands installed in the interior channel 104 of the body roller 102. Additionally, the vortex end cap 122 reduces stress and wear on the resistance bands and the body roller 102. In some embodiments, the vortex end cap 122 is permanently fixed within the guide 106. In other embodiments, the vortex end cap 122 is removable to facilitate replacement or adjustment. In some embodiments, the vortex end cap 122 is made of a low-friction material or a material that is non-reactive with the resistance bands and the materials of the body roller 102 and the guide 106.

Figure 4:
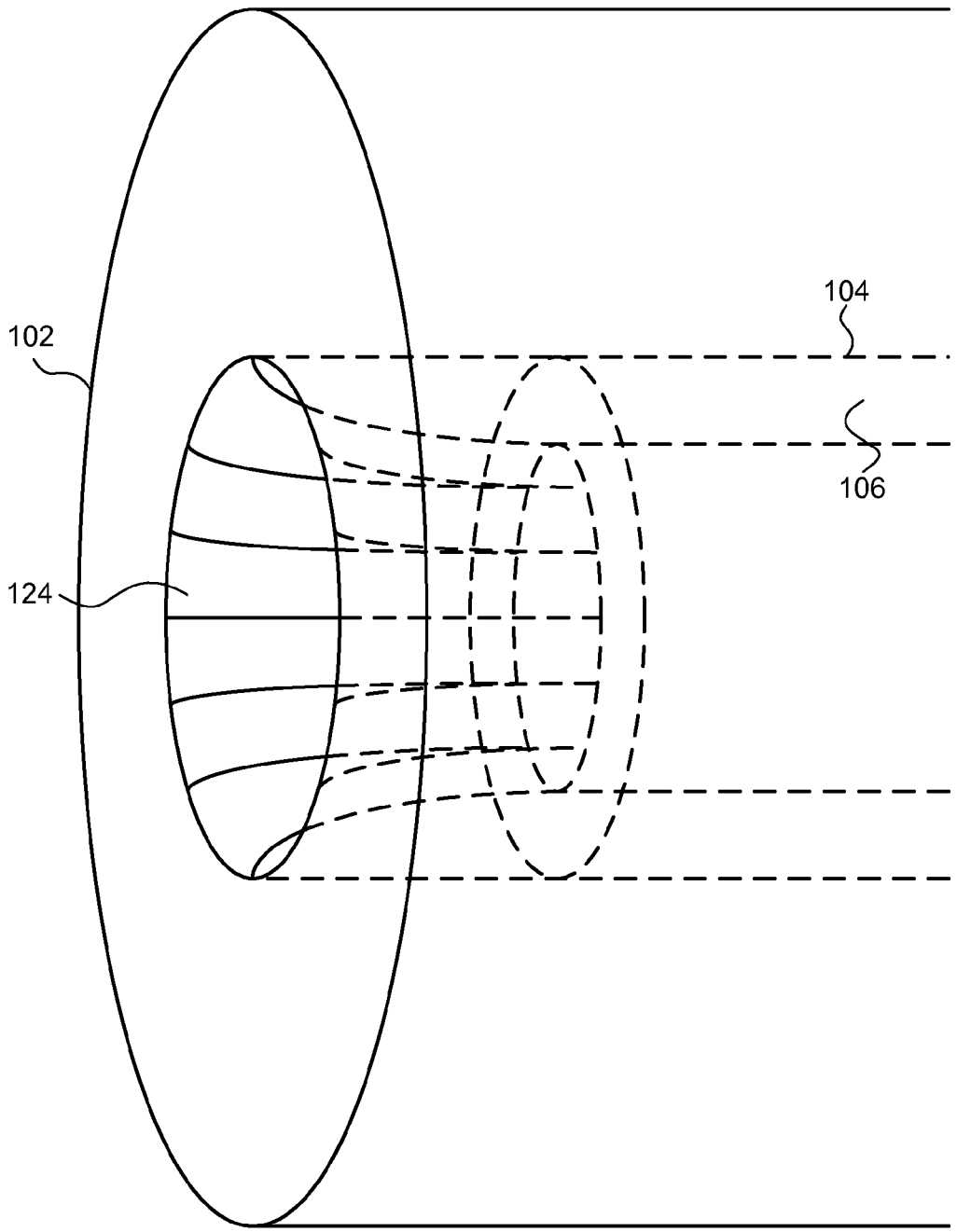
FIG. 4 illustrates a schematic view of one embodiment of a flared end cap installed within a body roller.

FIG. 4 illustrates a schematic view of one embodiment of a flared end cap 124 installed within a body roller 102. In the illustrated embodiment, the flared end cap 124 is installed to be flush with the end of the body roller 102. However, in some embodiments, the flared end cap 124 may be recessed within or extended beyond the threshold of the body roller 102. The flared end cap 124 reduces stress and wear on the resistance bands as well as the body roller 102. In some embodiments, different flared end caps 124 may be used to adjust the open space in the interior channel 104 where the resistance bands pass through the body roller 102.

Figure 5A:
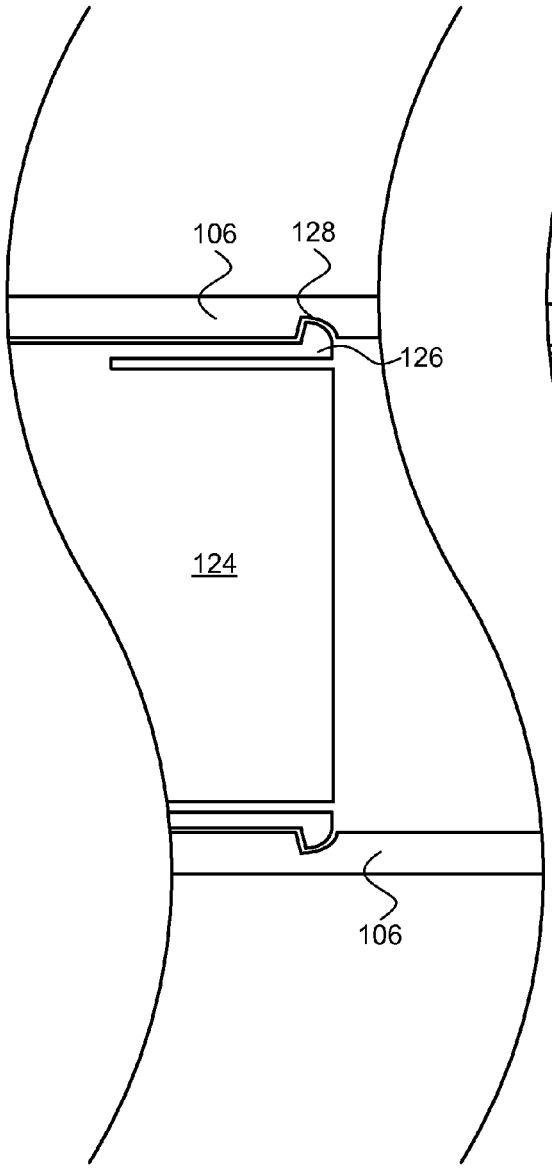
FIGS. 5*a-c* illustrate schematic diagrams of some embodiments for securing an end cap within the guide in the interior channel of the body roller.

FIG. 5*a* illustrates a schematic diagram of one embodiment for securing an end cap 124 within the guide 106 in the interior channel 104 of the body roller 102. In the illustrated embodiment of FIG. 5*a*, the end cap 124 (here shown as 124 but may be 122 or another type of end cap) is secured within the guide 106 with a snap arm 126 of the end cap 124 engaged with a snap groove 128. In some embodiments, the illustrated connection is permanent and does not facilitate removal except upon failure of the snap arm 126. In another embodiment, the connection facilitates removal to change the type of end cap or for replacement of the end cap 124.

Figure 5B:
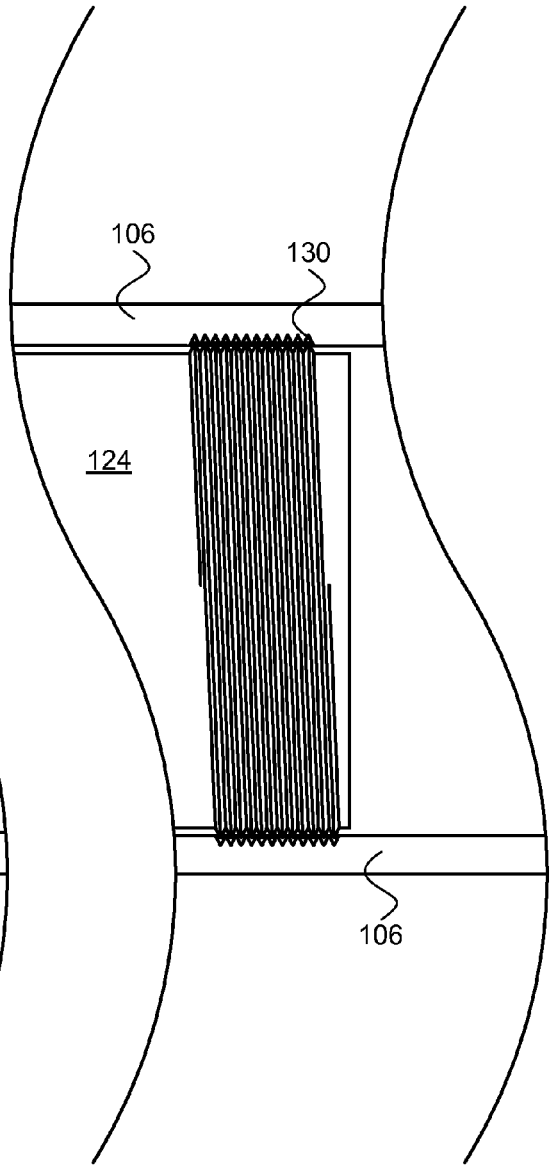

FIG. 5*b* illustrates a schematic diagram of another embodiment for securing an end cap within the guide 106 in the interior channel 104 of the body roller 102. In the illustrated embodiment, the end cap 124 is connected within the guide 106 via a thread interface 130. The thread interface 130 allows a user to attach the end cap 124 in a non-permanent manner that is still solid and secure. The thread interface may allow for a superior connection during a workout when a relatively high level of stress is applied by the resistance bands upon the end cap 124. Other types of connections may also have improved stress handling properties.

Figure 5C:
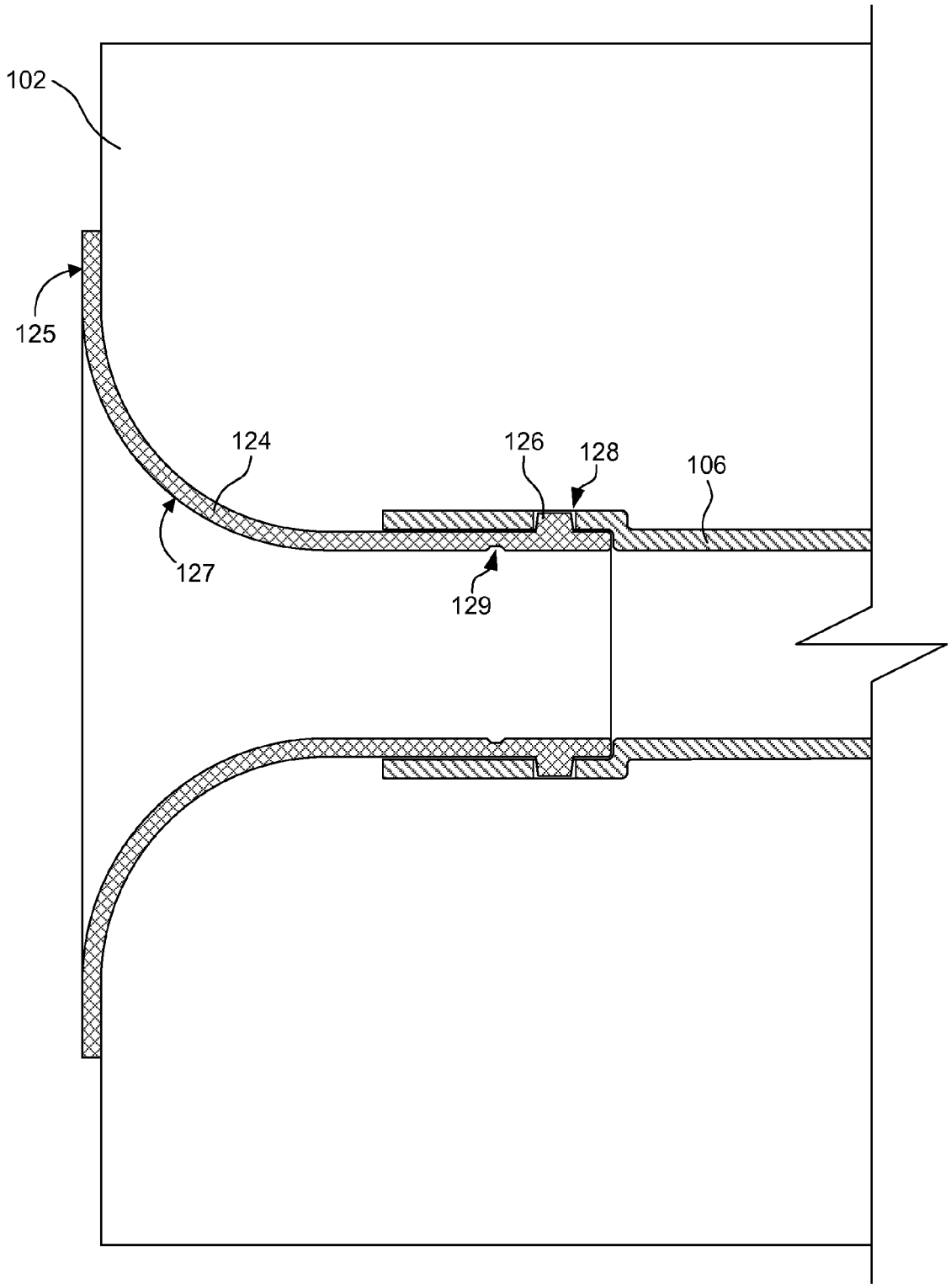

FIG. 5*c* illustrates a schematic diagram of another embodiment for securing an end cap 124 within the guide 106 in the interior channel 104 of the body roller 102. For reference, the cutaway sidewalls of the end cap 124 are designated with cross-hatching, while the cutaway sidewalls of the guide 106 are designated with hatching. In the illustrated embodiment, the end cap 124 is secured within the guide 106 with one or more snap arms 126. Each snap arm 126 has an engagement feature (e.g., button) which extends outward from the outer surface of the end cap 124. Each snap arm 126 also has a flex joint 129 on the inner surface 127 at which the snap arm 126 is configured to flex in response to an inward force on the engagement feature of the snap arm 126. Upon insertion of the connecting portion (including the snap arms 126) of the end cap 124 into the mating portion of the guide 106, the snap arms 126 and engagement feature flex inward (at the flex joint 129) until the end cap 124 is inserted far enough for the engagement feature to engage the hole 128 in the mating portion of the guide 106.

In the depicted embodiment, the inner diameter and cross-sectional area of the connecting portion of the end cap 124 is approximately the same size and configuration as the mating corresponding dimensions of the central portion of the guide 106. In order to accommodate this configuration, the mating portion of the guide 106 has an inner diameter and cross-sectional area that is large enough and compatible with the outer dimensions and cross-sectional geometry of the connecting portion of the end cap 124. In this way, resistance tubing (not shown) passing through the guide 106 and the end cap 124 will not experience any significant disruptions or contact at the joint between the end cap 124 and the guide 106. Rounded finishes on exposed surfaces 125 may also help to minimize potential disruptions and/or contact.

Additionally, FIG. 5*c* illustrates a substantially continuous and smooth transition surface 127 which is flared to transition from the cylindrical sidewalls of the connecting portion of the end cap 124 to a ring-shaped flange with an exposed surface 125 that is approximately orthogonal to the cylindrical sidewalls of the connecting portion. In one embodiment, the dimensions of the guide 106 and end cap 124 are arranged so that when the engagement feature of the snap arm 126 is engaged with the corresponding hole 128 of the guide 106, the back surface of the outer flange of the end cap 124 is in contact with the corresponding end surface of the body roller. Although not shown, in a further embodiment the outer flange of the end cap 124 may place an inward force on the corresponding surface of the body roller 102 in response to dimensions which ensure a "tight" fit between the guide 106, the end cap 124, and the body roller 102. In some embodiments, the inward force causes the outer flange of the end cap 124 to depress into the corresponding surface of the body roller 102, up to a depth approximately equal to the thickness of the outer flange of the end cap 124.

Figure 6:
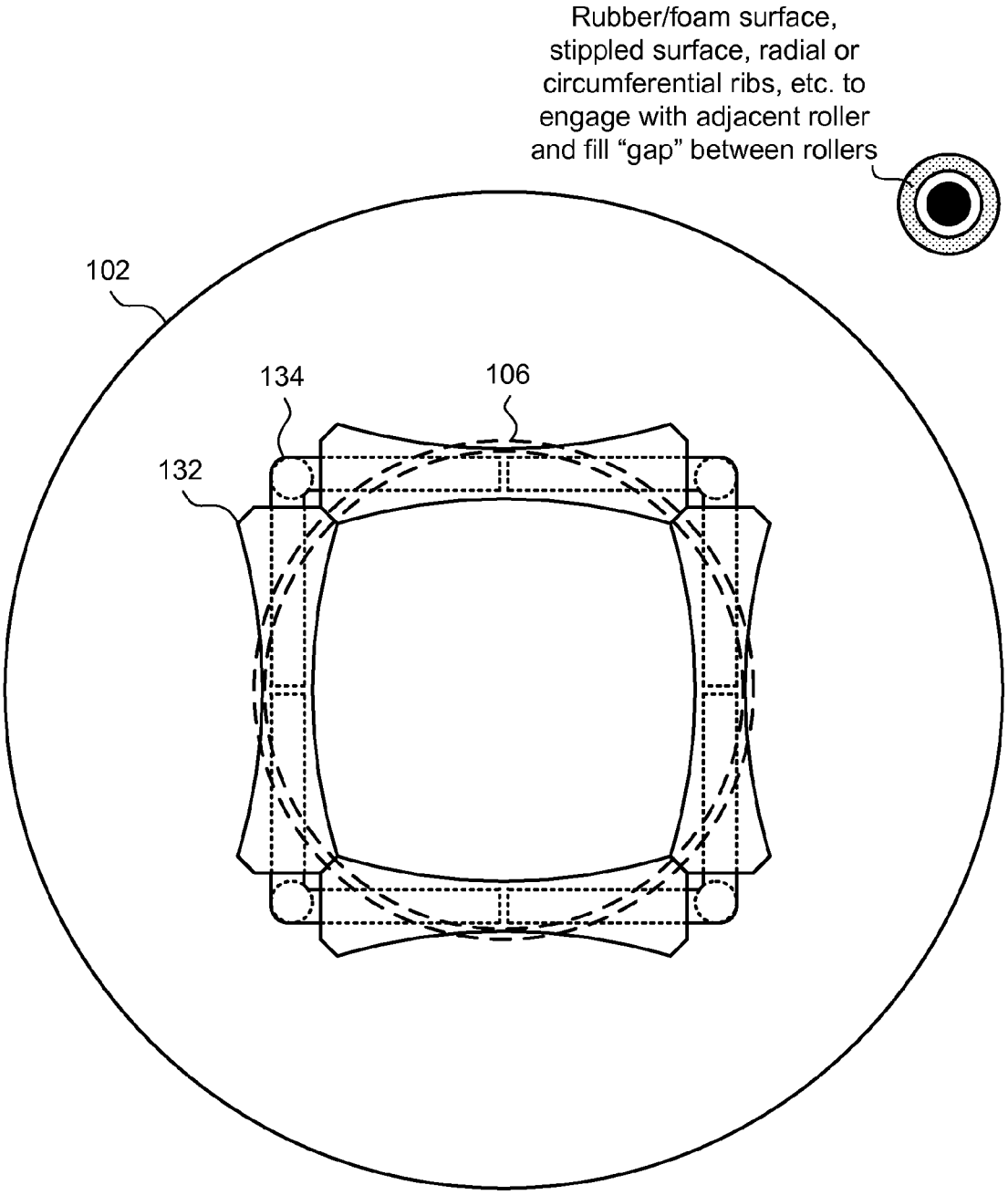
FIG. 6 illustrates one embodiment of a unidirectional pulley.

FIG. 6 illustrates one embodiment of a unidirectional pulley. The unidirectional pulley is configured to provide a roller surface at any point around a 360 degree opening of the guide 106. The unidirectional pulley may be used at the inlet/outlet of any pipe or channel through which cords, wires, ropes, bands, tubing, chains, or other string-like materials are passed. In the depicted embodiment, there are four rollers 132 mounted together on frame shafts 134 (shown dashed) around the perimeter of the guide 106 (also shown dashed) within the body roller 102. Other mounting structures may be used to mount the unidirectional pulley directly to the guide 106 or another pipe, for example using a clamping mechanism on the outside of a pipe. The surface of each roller 132 is curved to provide a somewhat circular opening through which the tubes can pass. The ends of each roller 132 are canted. Although four rollers 132 are shown, other embodiments may include fewer or more rollers 132 with different curvatures and cant geometries. In some embodiments, a separate mounting structure may be provided which mounts to the guide 106 (or body roller 102) and separate secures portions of the mounting frames 134 so that the frame shafts can secure the rollers 132 in the closed geometry.

Further embodiments are also described and envisioned which combine features and/or functionality of various embodiments already described herein. Any feature and/or function from any embodiment described herein may be implemented in combination with any other feature and/or function of any other embodiment(s) described separately above.

In one embodiment, an apparatus for exercising includes a body roller and at least one resistance band. The body roller defines an interior channel. The interior channel may run axially through the body roller. Alternatively, the interior channel may run in a different direction through the body roller or, in the case of a body roller which does not have a definite axial dimension, may run any direction parallel, orthogonal, or otherwise non-parallel to the primary dimensional length of the body roller. The one or more resistance bands may be any type and/or of elastic resistance device, including tubing, bands, bungees, and so forth. The one or more resistance bands pass through the interior channel of the body roller, and ends of the resistance bands extend outward on each side of the body roller.

In some embodiments, the interior channel of the body roller has a central portion and an end portion. The central portion of the interior channel has a first cross-sectional area. The end portion of the interior channel has a second cross-sectional area. The first cross-sectional area is smaller than the second cross-sectional area. In other embodiments, the first and second cross-sectional areas are different from each other, and in further embodiments the first cross-sectional area is larger than the second cross-sectional area.

In some embodiments, a guide is disposed within the interior channel of the body roller. The guide may be made of any material (e.g., metal, plastic, rubber, etc.) which provides structural support to the body roller. The guide also provides protection to the body roller from wear due to movement of the resistance band within the guide. Depending on the implementation, the guide may be formed in one integral piece or, alternatively, in multiple pieces and assembled within the interior channel of the body roller. For reference, end portions of the guide may be referred to as mating portions to couple with separately formed end caps.

With reference to a lateral length of the guide, the central portion between the end portions of the guide may be referred to as a central portion. In some embodiments, the guide includes a central portion and a flared end portion. The flared end portion is configured to facilitate a directional transition of the resistance band from a first direction through the central portion of the guide (and substantially parallel to an axis of the body roller) to a second direction that is different from the first direction. In some embodiments, the flared end portion of the guide includes a substantially smooth and continuous surface which transitions from a cylindrical inner surface of the guide to an exposed surface that is substantially orthogonal to the cylindrical inner surface. The exposed surface may form an arc of about 90 degrees (or between about 75-105 degrees, or greater).

In some embodiments, the flared end portion of the guide includes a flexible snap arm with an outwardly extending protrusion or feature. An interior sidewall of the central portion of the guide defines a corresponding snap depression, groove, or hole to receive the outwardly extending protrusion of the flexible snap arm when the end cap is mated with the mating portion of the guide. Thus, the flared end cap can be secured to the central portion of the guide.

In some embodiments, the flared end portion comprises a vortex end cap having a partially toroidal geometry. The partially toroidal geometry is defined by a semicircular cross-sectional area that is rotated around a central point to form a structure similar to the inner curvature of a donut or ring. The vortex end cap is configured to be coupled to an interior surface of an end portion of the guide. Alternatively, the vortex end cap may be coupled to an end of the guide. Other embodiments may use alternative geometrical configurations to form and/or attach the toroidal structure to the guide and/or the body roller. In some embodiments, the vortex end caps are configured to removably couple to the interior surface of the guide. In some embodiments, the vortex end caps are configured to permanently couple to the interior surface of the guide.

In some embodiments, a plurality resistance bands having different lengths and/or resistances pass through the guide and/or interior channel of the body roller. In some embodiments, the interior channel and/or guide comprises a storage region to store the resistance band, as well as any attachments. In some embodiments, the body roller further includes at least one end cap (similar to a lid) to at least partially enclose the interior channel. In some embodiments, the resistance band includes at least one attachment point to attach a handle or other user interface accessory (e.g., strap, block, etc.).

In one embodiment, a method for making the exercise apparatus includes installing a resistance band within an interior channel of a body roller. The ends of the band can extend out of opposite ends of the interior channel of the body roller. The method also includes connecting a user interface accessory to an end of the resistance band. The user interface accessory is configured to facilitate user manipulation of the resistance band while a portion of the resistance band is disposed within the interior channel of the body roller. In some embodiments, a connector facilitates connection of multiple bands to the same handle or other user interface accessory.

In some embodiments, the method also includes disposing at least one end cap at the at least one end of the body roller. The end cap is disposed within the body roller and surrounding the at least one resistance band to reduce wear on the body roller from the at least one resistance band. The end cap may be installed before or after the resistance band is disposed within the body roller. In some embodiments, the end cap includes a flared end portion with a substantially smooth and continuous surface which transitions from a cylindrical inner surface to an exposed surface that is substantially orthogonal to the cylindrical inner surface. In some embodiments, the end cap is integrated with a structural guide which reinforces the interior channel of the body roller. In some embodiments, the end cap is removably coupled to the body roller. In some embodiments, the end cap includes a vortex end cap having a partially toroidal geometry with a semicircular cross-sectional area. The vortex end cap comprises a smallest interior diameter that is less than a diameter of the interior channel of the body roller.

In some embodiments, a system for exercising includes application means, resistance means, and interface means. The application means are configured to apply rolling pressure to a body. Any known or new body roller device may form application means, including conventional foam rollers on which a user sits or otherwise applies body weight, as well as handheld or other rollers. The resistance means is coupled to the application means. The resistance means is extendible from end portions of the application means. The resistance means may supply resistance against user movement through any mechanical and/or electromechanical or electromagnetic force. Elastic deformation provides one form of resistance, although other embodiments may be implemented based on bearings, magnets, or other physical resistance principles. The interface means is coupled to the resistance means. The interface means facilitate handling of the resistance means by a user. Examples of possible interface means include, but are not limited to, padded handles, stiff handles, wrist straps, angle straps, waist straps or belts, head straps, gloves, socks, blocks or other bulk structures, and so forth.

Embodiments described herein may take the form of a pre-made roller with the bands and caps installed. Other embodiments may include a kit to retrofit a conventional body roller (having an interior channel and possibly also a structural guide) with end caps and one or more resistance bands, as well as any other accessories.

In some embodiments, the resistance bands may be replaced by a spring-loaded reel attached at each end of the body roller. In another embodiment, the body roller has grooves in the outer surface at approximately each end of the body roller. The grooves may facilitate temporarily attaching a resistance band to each end of the body roller by wrapping a looped end into each groove.

In the above description, specific details of various embodiments are provided. However, some embodiments may be practiced with less than all of these specific details. Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. An apparatus for exercising, the apparatus comprising:

a body roller comprising an interior channel and end surfaces;

at least one resistance band passing through the interior channel of the body roller and extending outward from the body roller through the end surfaces; and a guide within the interior channel of the body roller, the guide comprising:

a central portion with an interior sidewall defining a corresponding snap depression, groove, or hole; and an end portion, wherein the end portion comprises a flexible snap arm with an outwardly extending protrusion corresponding to the snap depression, groove, or hole of the central portion, the outwardly extending protrusion of the flexible snap arm to engage the corresponding to the snap depression, groove, or hole and thereby secure the end portion to the central portion of the guide.

2. The apparatus of claim 1, wherein the guide provides structural support to the body roller and provides protection to the body roller from wear due to movement of the resistance band within the guide.

3. The apparatus of claim 1, wherein the end portion comprises a flared end portion to facilitate a directional transition of the resistance band from a first direction through the central portion of the guide, wherein the first direction is substantially parallel to an axis of the body roller, to a second direction that is different from the first direction.

4. The apparatus of claim 3, wherein the flared end portion of the guide comprises a substantially smooth and continuous surface which transitions from a cylindrical inner surface of the guide to an exposed surface that is substantially orthogonal to the cylindrical inner surface.

* * * * *